US007919930B2

(12) United States Patent
Sugimura et al.

(10) Patent No.: US 7,919,930 B2
(45) Date of Patent: Apr. 5, 2011

(54) COIL COMPONENT AND DISPLAY DEVICE USING SAME

(75) Inventors: Tomohiro Sugimura, Osaka (JP); Sadao Morimoto, Hyogo (JP); Katsumi Matsumura, Hyogo (JP)

(73) Assignee: Panasonic Corporation, Osaka (JP)

( * ) Notice: Subject to any disclaimer, the term of this patent is extended or adjusted under 35 U.S.C. 154(b) by 576 days.

(21) Appl. No.: 11/913,230

(22) PCT Filed: Apr. 6, 2006

(86) PCT No.: PCT/JP2006/307312

§ 371 (c)(1),
(2), (4) Date: Oct. 31, 2007

(87) PCT Pub. No.: WO2006/134712

PCT Pub. Date: Dec. 21, 2006

(65) Prior Publication Data

US 2009/0033242 A1 Feb. 5, 2009

(30) Foreign Application Priority Data

Jun. 15, 2005 (JP) ..... 2005-174582
Jun. 15, 2005 (JP) ..... 2005-174583

(51) Int. Cl.
*H05B 41/16* (2006.01)
*H05B 37/00* (2006.01)

(52) U.S. Cl. ..... 315/277; 315/312

(58) Field of Classification Search ..... 315/276, 315/278, 279, 281, 312, 291, 307; 336/220, 336/221, 222

See application file for complete search history.

(56) References Cited

U.S. PATENT DOCUMENTS

| | | | | |
|---|---|---|---|---|
| 3,003,081 | A * | 10/1961 | Huberty et al. | 315/257 |
| 5,122,947 | A * | 6/1992 | Hishiki | 363/61 |
| 6,747,421 | B2 | 6/2004 | Kohn | |
| 7,075,244 | B2 * | 7/2006 | Kang et al. | 315/212 |
| 7,116,205 | B2 * | 10/2006 | Hsueh et al. | 336/212 |
| 7,166,969 | B2 * | 1/2007 | Kohno | 315/209 PZ |
| 7,446,750 | B2 * | 11/2008 | Moon | 345/102 |
| 2004/0183448 | A1 * | 9/2004 | Hsueh et al. | 315/57 |
| 2005/0099143 | A1 * | 5/2005 | Kohno | 315/312 |

FOREIGN PATENT DOCUMENTS

| | | |
|---|---|---|
| CN | 1298190 A | 6/2001 |
| CN | 1438762 A | 8/2003 |
| JP | 08-236362 | 9/1996 |
| JP | 2002-231034 | 8/2002 |
| JP | 2004-111417 | 4/2004 |
| JP | 2004-207342 | 7/2004 |
| JP | 2004-335443 | 11/2004 |

OTHER PUBLICATIONS

Chinese Office action for Appl. No. CN 2006800197827 Dated Jan. 8, 2010.

* cited by examiner

*Primary Examiner* — Douglas W Owens
*Assistant Examiner* — Minh D A
(74) *Attorney, Agent, or Firm* — Pearne & Gordon LLP

(57) ABSTRACT

The coil component comprises a primary coil, and a first secondary coil and a second secondary coil which are opposed to the primary coil. A first terminal is a terminal of the first secondary coil, that is a terminal for connection to one end of a lamp, and a second terminal is a terminal of the second secondary coil, that is a terminal for connection to the other end of the lamp. The first secondary coil and the second secondary coil are coaxially disposed, and the first terminal and the second terminal are reverse in polarity.

6 Claims, 18 Drawing Sheets

COIL COMPONENT AND DISPLAY DEVICE USING SAME

This application is a U.S. National Phase Application of PCT International Application PCT/JP2006/307312

TECHNICAL FIELD

The present invention relates to a coil component for voltage supply to a fluorescent lamp mounted with a display device or the like, and a display device using the same.

BACKGROUND ART

FIG. 13 is a circuit diagram of a display device using conventional coil components. In FIG. 13, inverter circuit 100 is formed of coil components 101, 102, and stabilizer circuit 103. Coil component 101 includes primary coil 101A and secondary coil 101B, and one end of secondary coil 101B is connected to one end of lamp 300. The other end of coil component 101 and one end of coil component 2 are connected to stabilizer circuit 103. The other end of coil component 102 is connected to the other end of lamp 300. Also, driving coil 200 is connected to the primary coil side of coil component 101, 102.

As preceding technical document information about this application, for example, Japanese Laid-open Patent 2002-231034 is commonly known.

In a display device using such a conventional coil component, there arises a problem of flicker on the display screen.

That is, in the conventional configuration described above, one end of lamp 300 as shown in FIG. 14 and the other end of lamp 300 are separately connected to coil components 101, 102. Consequently, the phase of current flowing to one end of lamp 300 as shown in FIG. 14 s deflected from the phase of current flowing to the other end as shown by current waveform (a) and current waveform (b). That is, current waveform (b) includes T2–T1 (sec.) time lag (phase lag) as against current waveform (a).

As an ideal configuration, current waveform (a) and current waveform (b) are desirable to be even in phase of the current as shown in FIG. 16. In this case, light emission of the lamp can be obtained as shown in FIG. 17A to FIG. 17G. In FIG. 17A to FIG. 17G, blank portion 301 is a light emitting portion, and shaded portion 302 is a light non-emitting portion. Even in case such emission of light is repeated, the light emitting portion and the light non-emitting portion are constant, and if the frequency is high enough, the person will not feel the flicker because human eyes are unable to follow it.

However, in a display device using a conventional coil component, because of the above-mentioned reason, since the phases are deflected from each other as shown by current waveform (a) and current waveform (b) in FIG. 14, the states of light emission become as shown in FIG. 15A to FIG. 15G in which the non-emitting portion (shaded portion 302) shifts with the lapse of time. As a result, flicker is generated on the display screen of the display device.

Also, in place of lamp 300, even when bar-like lamp 400, 500 is connected as shown in FIG. 18, the output currents of coil component 101 and coil component 102 respectively flow into one end and the other end of lamp 400 and lamp 500, causing similar phase deflection to take place, and flicker is generated on the display screen of the display device.

SUMMARY OF THE INVENTION

The coil component of the present invention comprises a primary coil, a first secondary coil opposing to the primary coil, and a second secondary coil, wherein a terminal at the high-voltage side of the first second secondary coil is a first terminal, a terminal at the high-voltage side of the second secondary coil is a second terminal, the first secondary coil and the second secondary coil are coaxially disposed, and also, the first terminal and the second terminal are reverse in polarity.

Also, the display device of the present invention comprises the above-mentioned coil component, a driving circuit, a lamp, and a control circuit. The driving circuit is connected to the first coil. One end of the lamp is connected to the first terminal, and the other end of the lamp is connected to the second terminal. The control circuit is connected to the driving circuit, which is also connected to a third terminal, the other end of the first secondary coil different from the first terminal, and to a fourth terminal, the other end of the second secondary coil different from the second terminal.

In the present invention having the above configuration, two secondary coils different in polarity are coaxially disposed, and there is no phase shift between the two secondary coils. As a result of reduction in phase shift of the current flowing in from both ends of the lamp connected to the two secondary coils, flicker on the display screen of the display device can be reduced.

REFERENCE MARKS IN THE DRAWINGS

7 Driving circuit
8, 80, 800 Coil component
8A Primary coil
8B First secondary coil
8BA First terminal
8BB Third terminal
8C Second secondary coil
8CA Second terminal
8CB Fourth terminal
16, 16A, 16B Lamp (first lamp)
18 Resistor
19 Control circuit

DETAILED DESCRIPTION OF THE PREFERRED EMBODIMENTS

Preferred Embodiment 1

The coil component and the display device using the same in the preferred embodiment 1 of the present invention will be described in the following with reference to FIG. 1 to FIG. 6.

Figure 1:
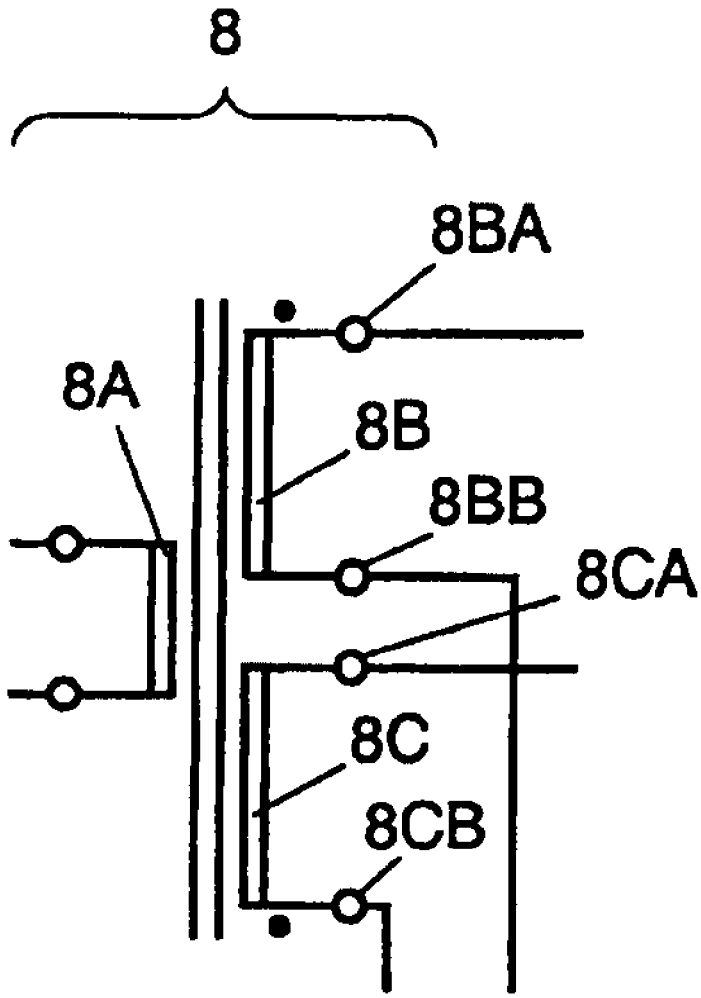
FIG. 1 is a circuit diagram of a coil component in the preferred embodiment 1 of the present invention.

FIG. 1 is a circuit diagram of a coil component in the preferred embodiment 1 of the present invention. The component elements of coil component 8, primary coil 8A, first secondary coil 8B, and second secondary coil 8C are opposed to each other. First secondary coil 8B includes first terminal 8BA (high-voltage side terminal) and third terminal 8BB. Second secondary coil 8C includes second terminal 8CA (high-voltage side terminal) and fourth terminal 8CB. Also, first secondary coil 8B and second secondary coil 8C are coaxially disposed, and first terminal 8BA and second terminal 8CA are reverse in polarity.

The detailed structure of coil component 8 is described in the following by using FIG. 2 and FIG. 3.

Figure 2:
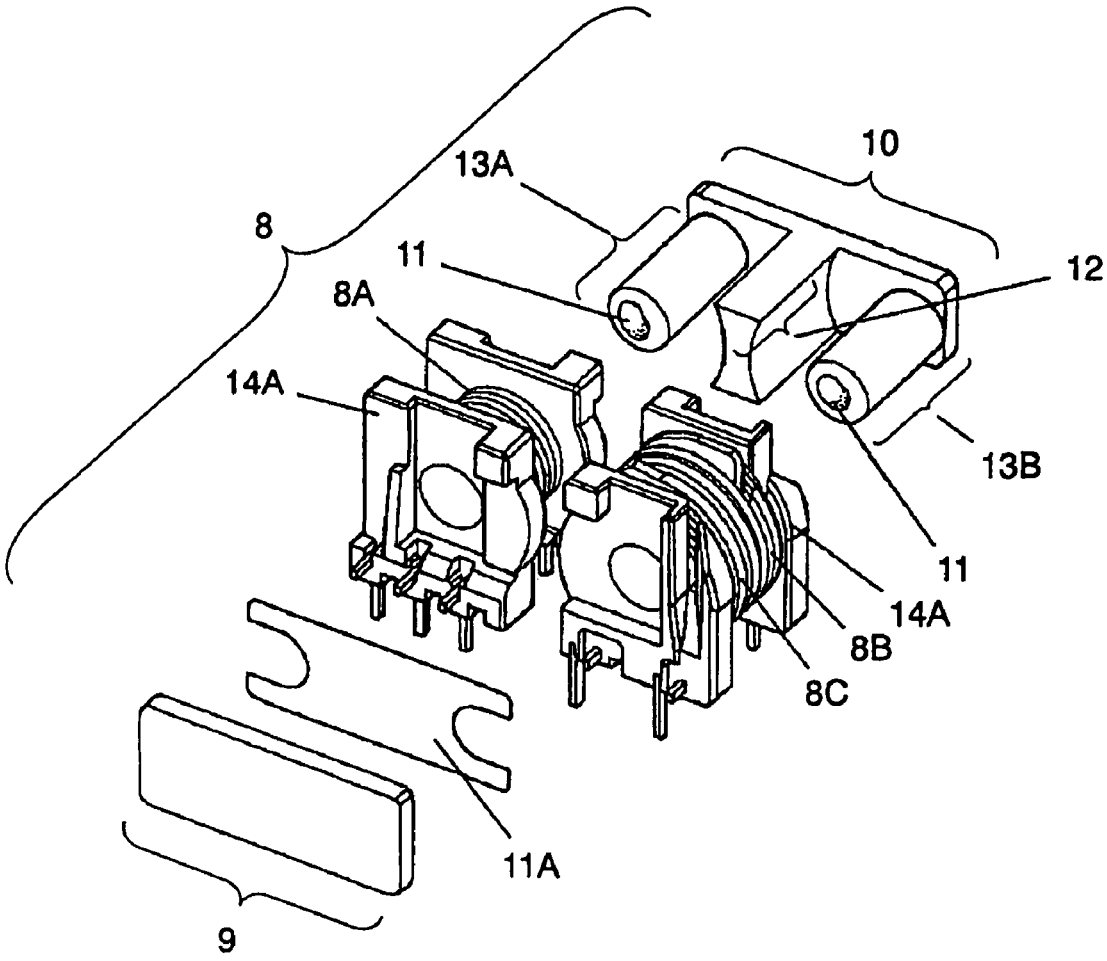
FIG. 2 is an exploded perspective view of a coil component in the preferred embodiment 1 of the present invention.

In FIG. 2, E-type split magnetic core 10 includes inner magnetic leg 12, and outer magnetic legs 13A, 13B opposing to each other with inner magnetic leg 12 disposed therebetween. Outer magnetic legs 13A, 13B of E-type split magnetic core 10 are coated with adhesive agent 11. Due to adhesive agent 11, I-type split magnetic core 9 disposed in a nearly horizontal direction against the mounting surface of E-type split magnetic core 10 is secured forming a first gap between outer magnetic legs 13A, 13B. Also, because of gap paper 11A therebetween, a second gap is formed between inner magnetic leg 12 and I-type split magnetic core 9. Thus, E-type split magnetic core 10 is combined with I-type split magnetic core 9, thereby forming a closed circuit magnetic core.

Figure 3:
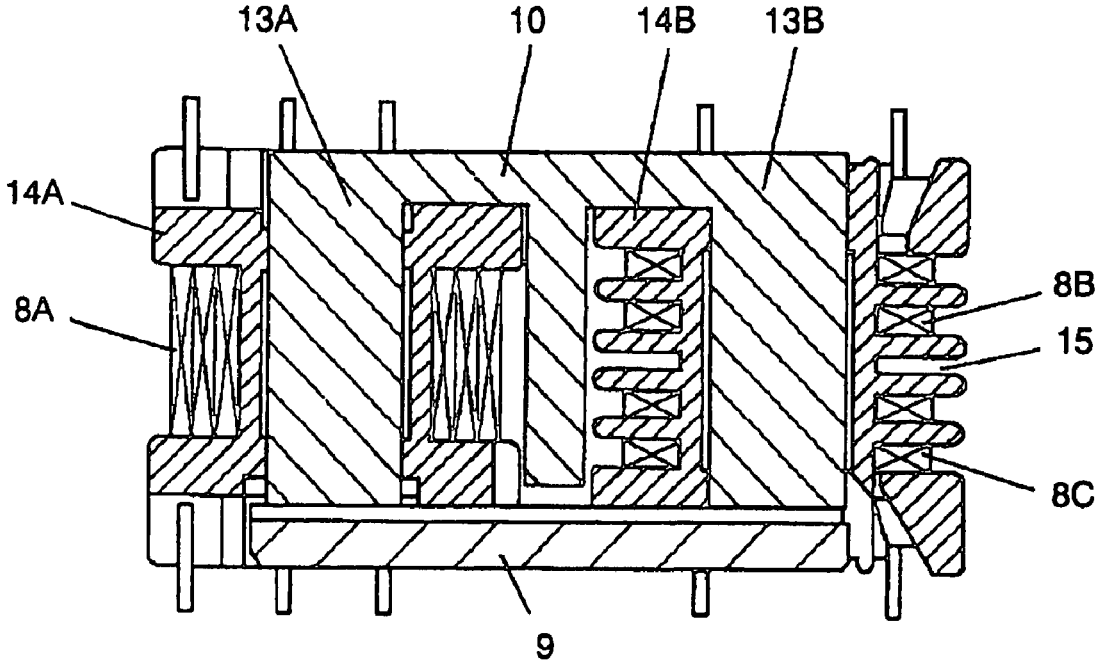
FIG. 3 is a sectional view of a coil component in the preferred embodiment 1 of the present invention.

And, as shown in FIG. 3, primary coil 8A is wound on outer magnetic leg 13A of E-type split magnetic core 10 via primary bobbin 14A, and first secondary coil 8B and second secondary coil 8C are wound on outer magnetic leg 13B via secondary bobbin 14B with groove 15 provided as a boundary.

Figure 4:
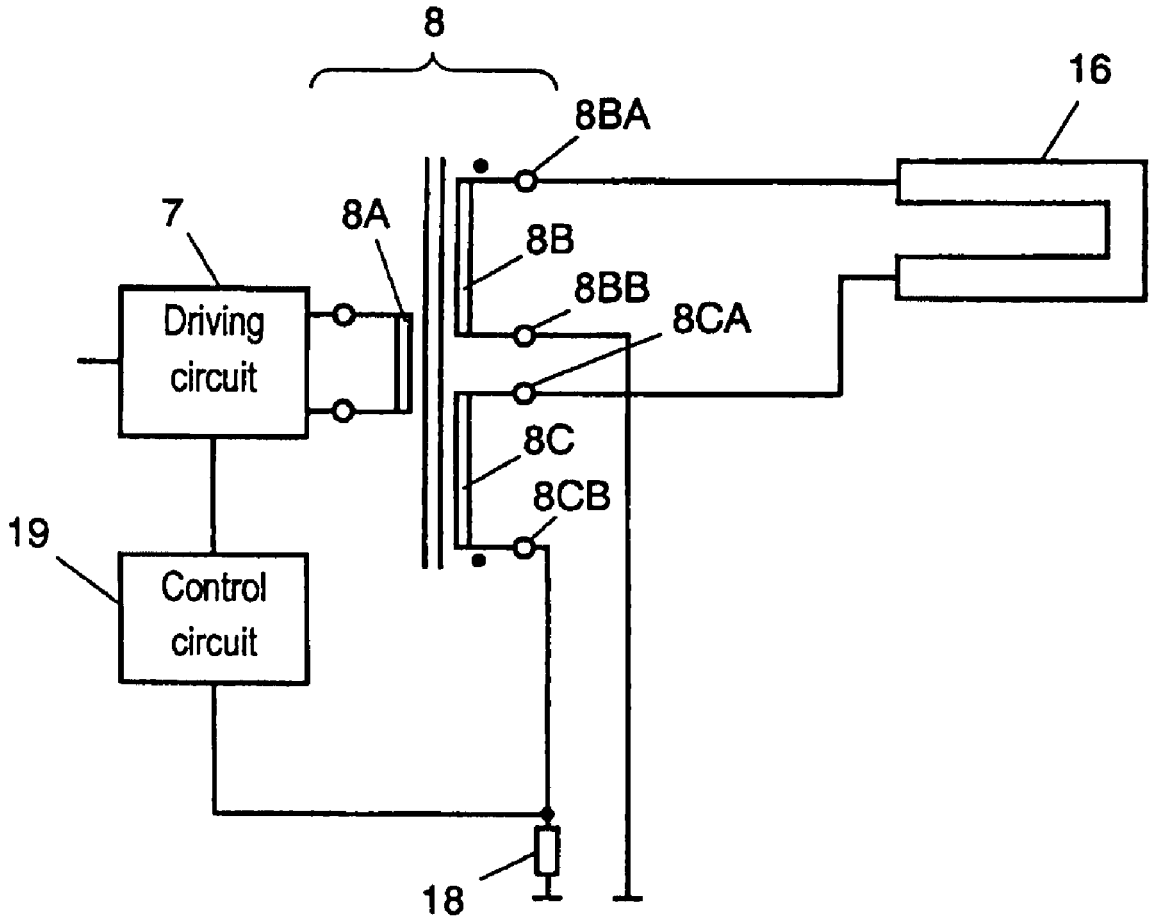
FIG. 4 is a circuit diagram of a display device using the coil component in the preferred embodiment 1 of the present invention.

FIG. 4 is a circuit diagram of a display device using the coil component in the preferred embodiment 1 of the present invention. In FIG. 4, first terminal 8BA is connected to one end of lamp 16 (called first lamp), and second terminal 8CA is connected to the other end of lamp 16. First terminal 8BA and second terminal 8CA are reverse in polarity. And, third terminal 8BB is directly connected to ground, and fourth terminal 8CB is connected to ground via resistor 18. Current flowing in resistor 18 is detected by control circuit 19 which directs driving circuit 7 to keep the amount of current flowing in lamp 16 at a specific level. In this way, the current flowing in lamp 16 becomes constant.

When a current flows in primary coil 8A with driving circuit 7 operated, the magnetic flux generated by the current runs through outer magnetic leg 13B shown in FIG. 3, and due to the magnetic flux, currents being even in phase are generated in first and second secondary coils 8B, 8C. Since the even phase currents flow in one end and the other end of lamp 16 respectively, the light emitting status becomes, as shown in FIG. 17, such that flicker is reduced on the display screen of the display device.

Further, lamp 16 can be lighted by one coil component 8, and it is possible to reduce the size of the whole display.

Also, since the amount of current is directly controlled by control circuit 19, the current flowing in lamp 16 is controlled with great accuracy.

Figure 5:
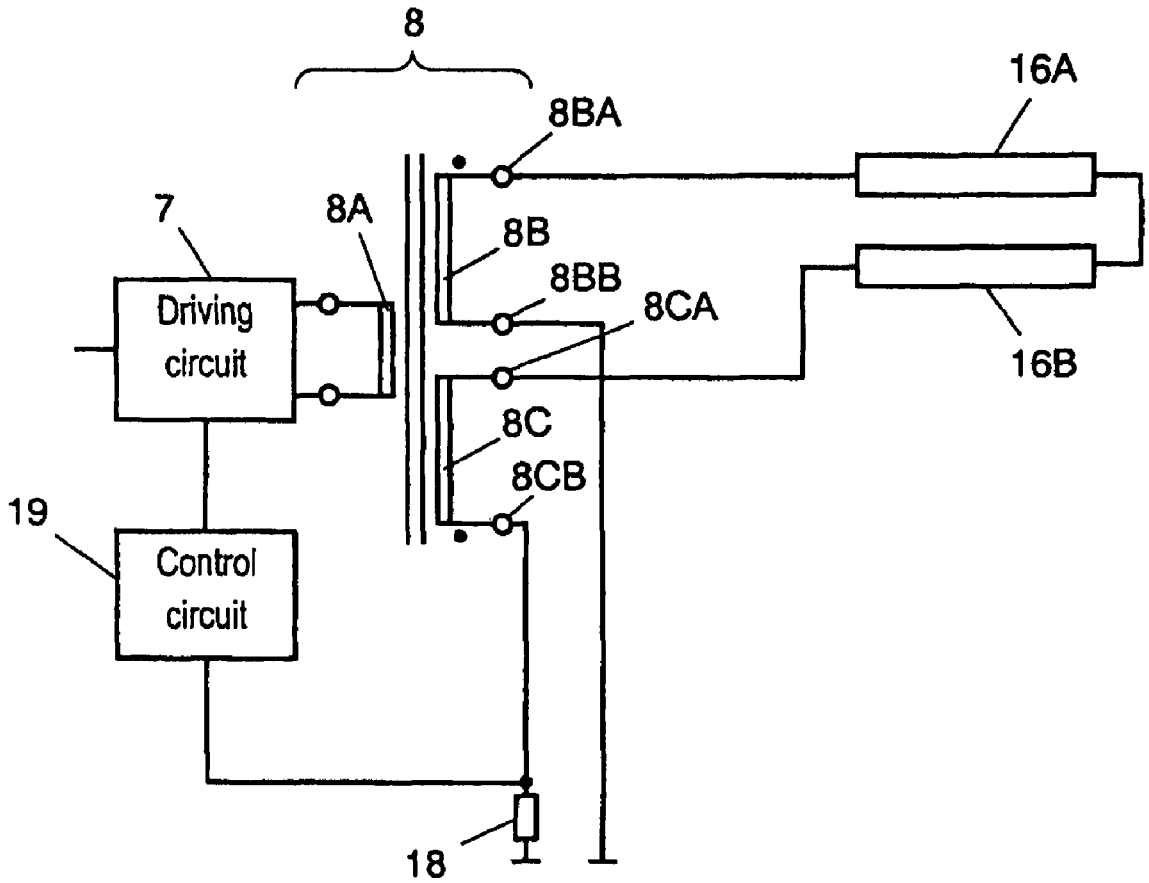
FIG. 5 is a circuit diagram of another display device using the coil component in the preferred embodiment 1 of the present invention.

In place of lamp 16, as shown in FIG. 5, it is also preferable to make the connection by using two lamps, lamp 16A and lamp 16B.

Figure 6:
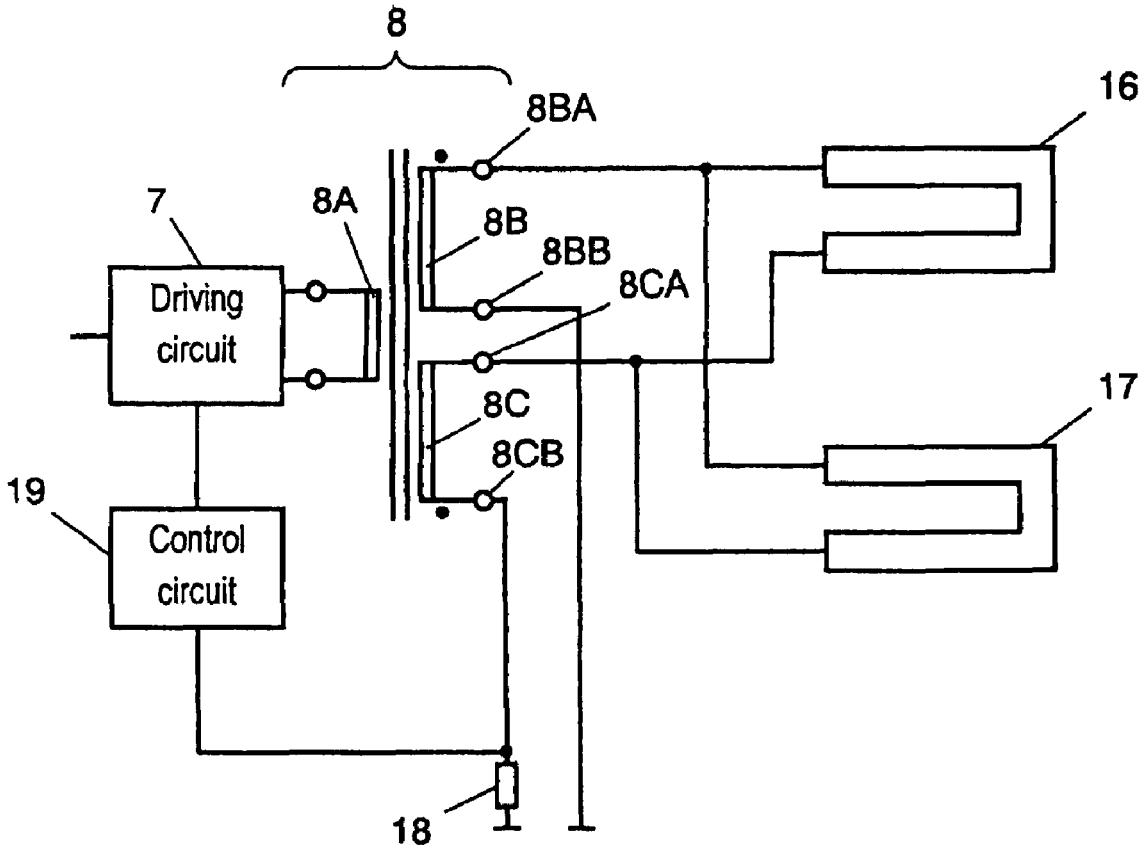
FIG. 6 is a circuit diagram of another display device using the coil component in the preferred embodiment 1 of the present invention.

Further, as shown in FIG. 6, it is also preferable to be configured in that there is provided second lamp 17 and one end of second lamp 17 is connected to first terminal 8BA and the other end of second lamp 17 is connected to second terminal 8CA, comprising two lamps 16, 17.

In the present preferred embodiment 1, a closed circuit magnetic core is formed by using I-shaped I-type split magnetic core 9 and E-shaped E-type split magnetic core 10 as used in the example, but it is also allowable to form a closed circuit magnetic core by using two E-type split magnetic cores 10 opposed to each other.

In this case, since the closed circuit magnetic core is formed by using two magnetic cores nearly symmetrical in shape, it is possible to improve the productivity and to reduce the assembling cost and the cost of magnetic cores.

Also, in case of forming the close circuit magnetic core by using two U-type split magnetic cores (not shown) having two legs opposed to each other, it is possible to improve the productivity and to reduce the assembling cost and the cost of magnetic cores because two magnetic cores nearly symmetrical to each other are used to form the closed circuit magnetic core.

Preferred Embodiment 2

The coil component and the display device using the same in the preferred embodiment 2 of the present invention will be described in the following with reference to FIG. 7 to FIG. 9.

The same configurations as in the preferred embodiment 1 are given same reference numerals, and the description is omitted.

Figure 7:
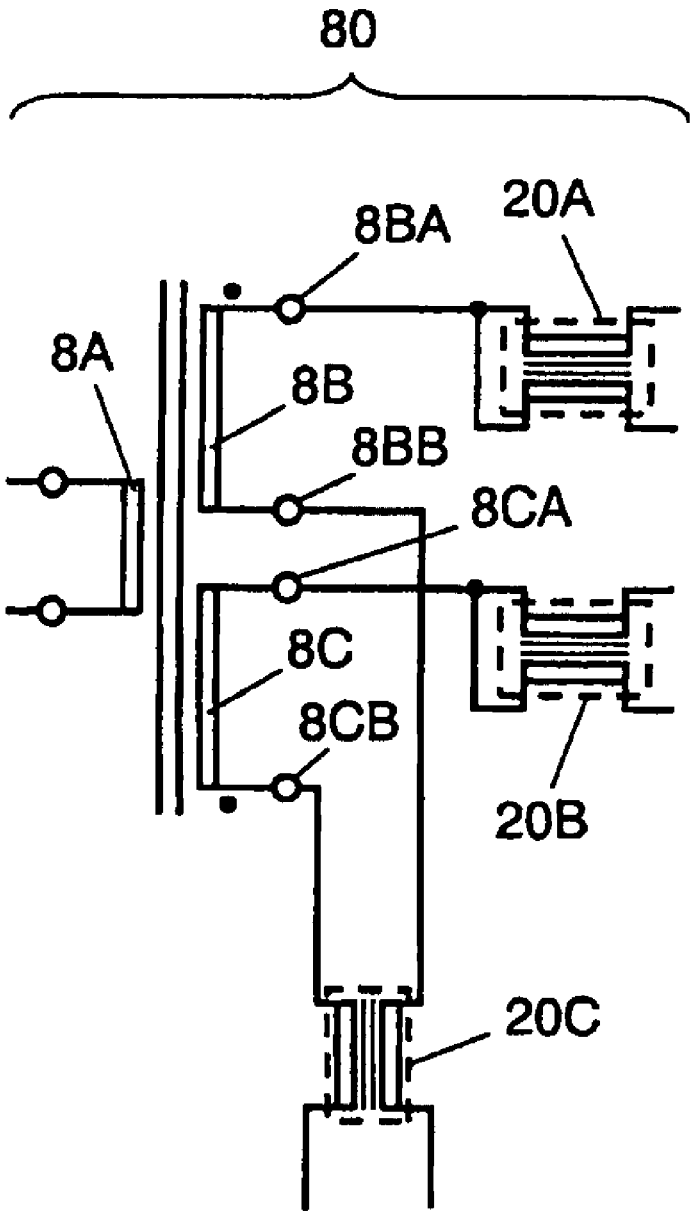
FIG. 7 is a circuit diagram of a coil component in the preferred embodiment 2 of the present invention.

FIG. 7 is a circuit diagram of a coil component in the preferred embodiment 2 of the present invention. The component elements of coil component 80, primary coil 8A, first secondary coil 8B, and second secondary coil 8C are opposed to each other. Also, first secondary coil 8B and second secondary coil 8C are coaxially disposed, and first terminal 8BA (high-voltage side terminal) and second terminal 8CA (high-voltage side terminal) are reverse in polarity.

And, first terminal 8BA and second terminal 8CA are respectively connected to one input end of balance coil 20A (called first balance coil) and one input end of balance coil 20B (called second balance coil).

Third terminal 8BB and fourth terminal 8CB are respectively connected to one and the other input ends of balance coil 20C (called third balance coil).

Figure 8:
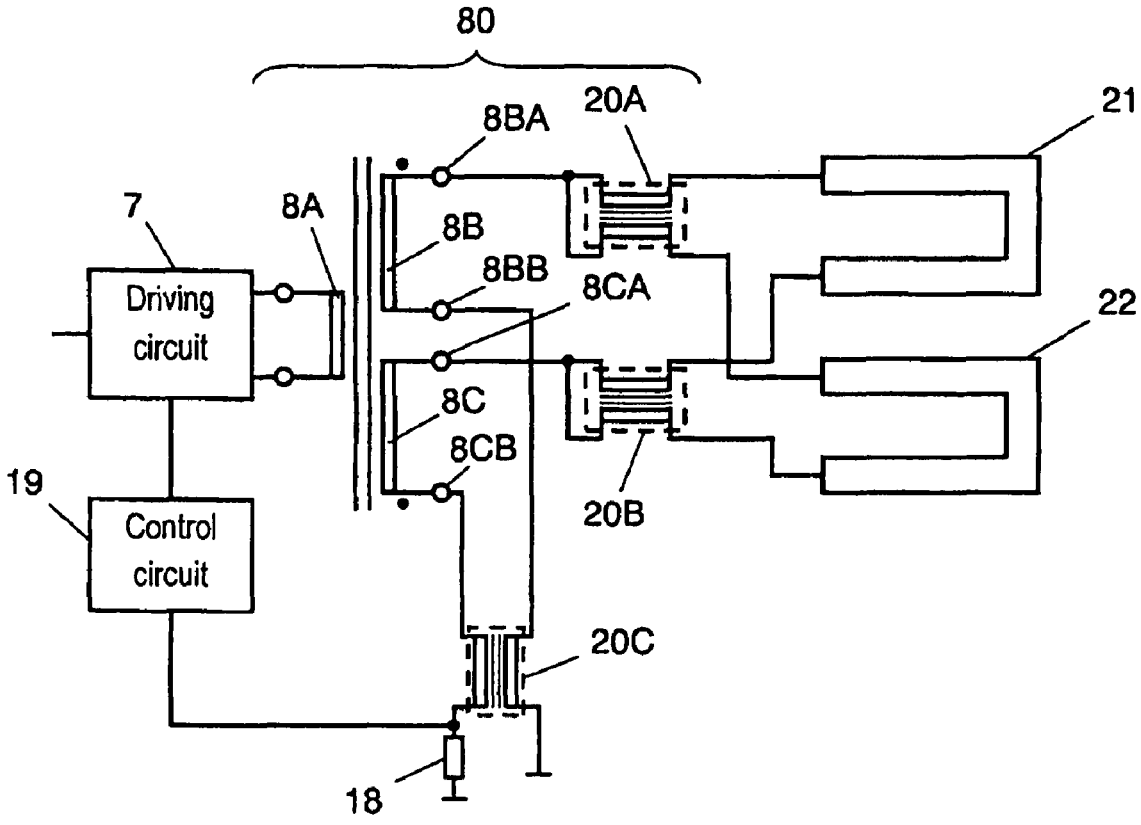
FIG. 8 is a circuit diagram of a display device using the coil component in the preferred embodiment 2 of the present invention.

FIG. 8 is a circuit diagram of a display device using the coil component in the preferred embodiment 2 of the present invention. In FIG. 8, one output end of balance coil 20A is connected to one end of lamp 21 (called first lamp), and the other output end of balance coil 20A is connected to one end of lamp 22 (called second lamp). Also, one output end of balance coil 20B is connected to the other end of lamp 21, and the other output end of balance coil 20B is connected to the other end of lamp 22.

Since there are provided balance coils 20A and 20B, one-sided application of current to lamp 21 or lamp 22 can be prevented.

Generally, since variation in impedance of lamps is included in the manufacture, when a current is applied to a plurality of lamps at the same time, one of the lamps is lighted earlier than the others. In that case, the energy is used by the lamp lighted, and the other lamps are not supplied with the energy and unable to light up. Also, even if they are lighted, the amounts of current flowing in the lamps are not uniform, causing the display to become uneven in brightness as a whole display. Balance coils 20A, 20B serve to prevent the occurrence of such problem.

One output end of balance coil 20C is connected to ground via resistor 18, and the other end is directly connected to ground.

Balance coil 20C maintains the balance between the current flowing from first secondary coil 8B to balance coil 20A and the current flowing from second secondary coil 8C to balance coil 20B, and thereby, it prevents the voltage applied to one end and the other end of lamps 21, 22 from becoming unbalanced.

And, control circuit 19 detects the current flowing in resistor 18 and directs driving circuit 7 to keep the amount of current at a certain level. In this way, the current flowing in lamps 21, 22 become constant.

When a current flows into primary coil 8A with driving circuit 7 operated, the magnetic flux generated by the current runs through outer magnetic leg 13B shown in FIG. 3, and due to the magnetic flux, currents being even in phase are generated in first and second secondary coils 8B, 8C. Since the even phase currents flow into one end and the other end of lamps 21, 22 respectively, the light emitting status becomes, as shown in FIG. 17, such that flicker is reduced on the display screen of the display device.

Further, since two lamps, lamps 21, 22 can be lighted by one coil component 80, it is possible to reduce the size of the whole display.

Also, since the amount of current is directly controlled by control circuit 19, the current flowing in lamps 21, 22 is controlled with great accuracy.

Further, there are provided balance coils 20A, 20B, and it is possible to prevent the one-sided application of current to lamp 21 or lamp 22. Also, lighting failure of the other lamp with one of the lamps lighted can be prevented, and it is possible to prevent the display from becoming uneven in brightness as a whole display.

Figure 9:
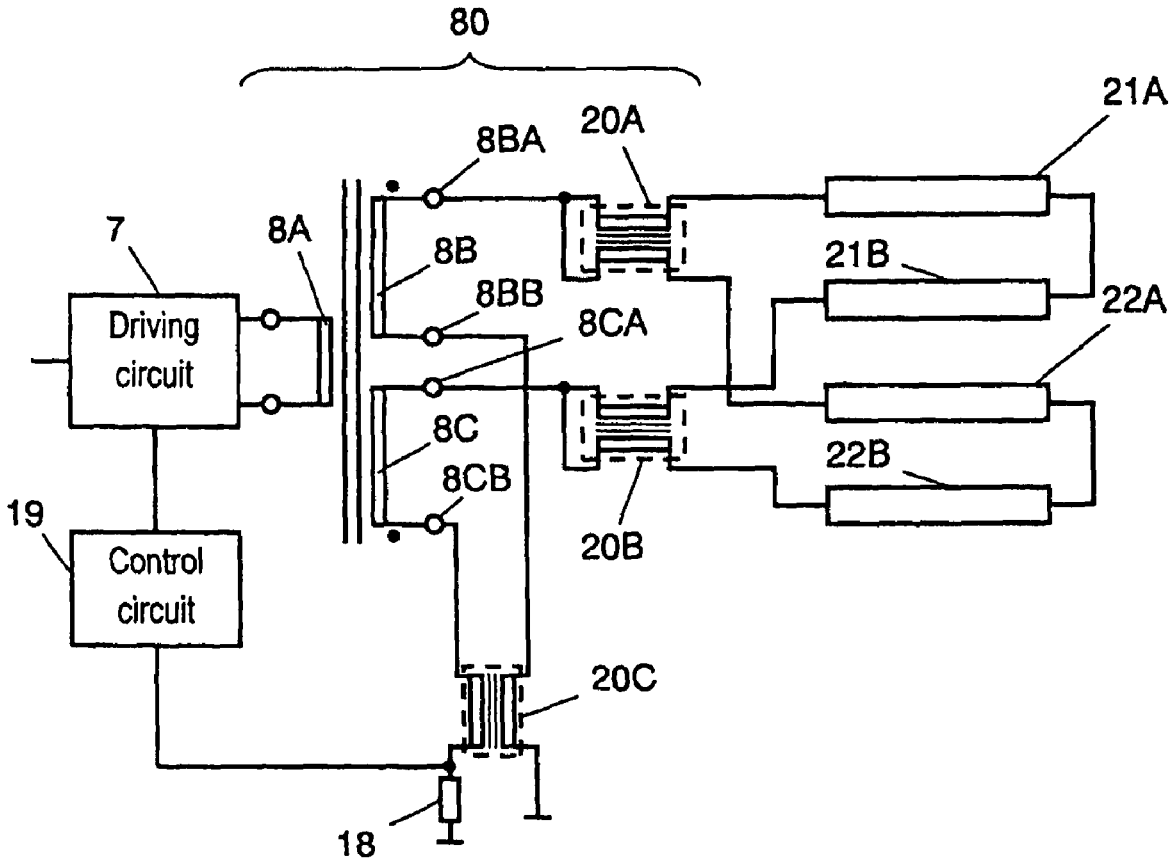
FIG. 9 is a circuit diagram of another display device using the coil component in the preferred embodiment 2 of the present invention.

In place of lamps 21, 22, as shown in FIG. 9, it is also preferable to have a configuration such that lamp 21A is connected to lamp 21B, and lamp 22A is connected to lamp 22B.

Preferred Embodiment 3

The coil component and the display device using the same in the preferred embodiment 3 of the present invention will be described in the following with reference to FIG. 10 to FIG. 12.

The same configurations as in the preferred embodiments 1, 2 are given same reference numerals, and the description is omitted.

Figure 10:
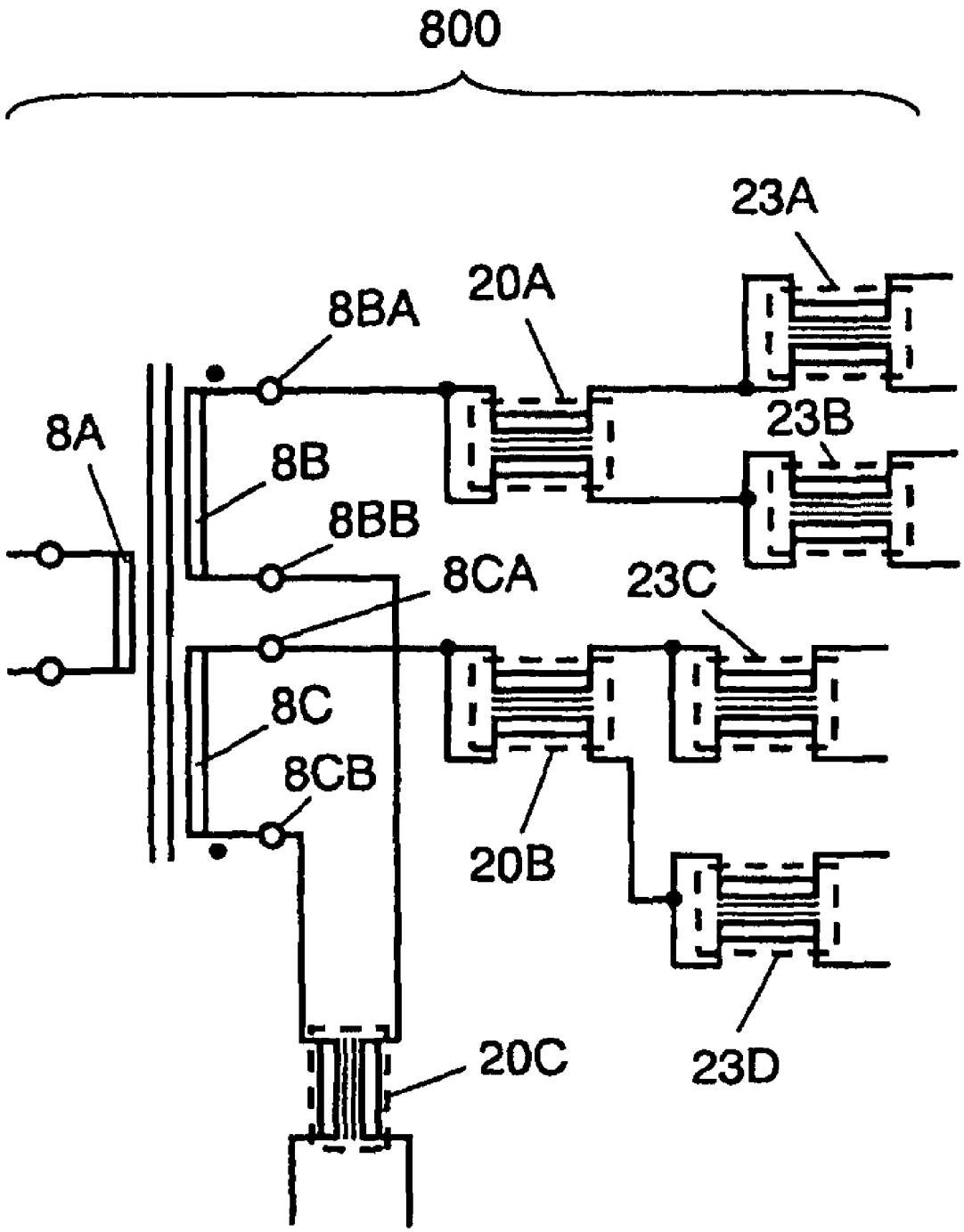
FIG. 10 is a circuit diagram of a coil component in the preferred embodiment 3 of the present invention.

FIG. 10 is a circuit diagram of a coil component in the preferred embodiment 3 of the present invention. In FIG. 10, coil component 800 further includes balance coil 23A (called fourth balance coil), 23B (called fifth balance coil), 23C (sixth balance coil), and 23D (called seventh balance coil) in addition to the configuration of coil component 80 in the preferred embodiment 2.

One output end of balance coil 20A is connected to the input side of balance coil 23A, and the other output end of balance coil 20A is connected to the input side of balance coil 23B. Also, one end output end of balance coil 20B is connected to the input side of balance coil 23C, and the other output end of balance coil 20B is connected to the input side of balance coil 23D.

Figure 11:
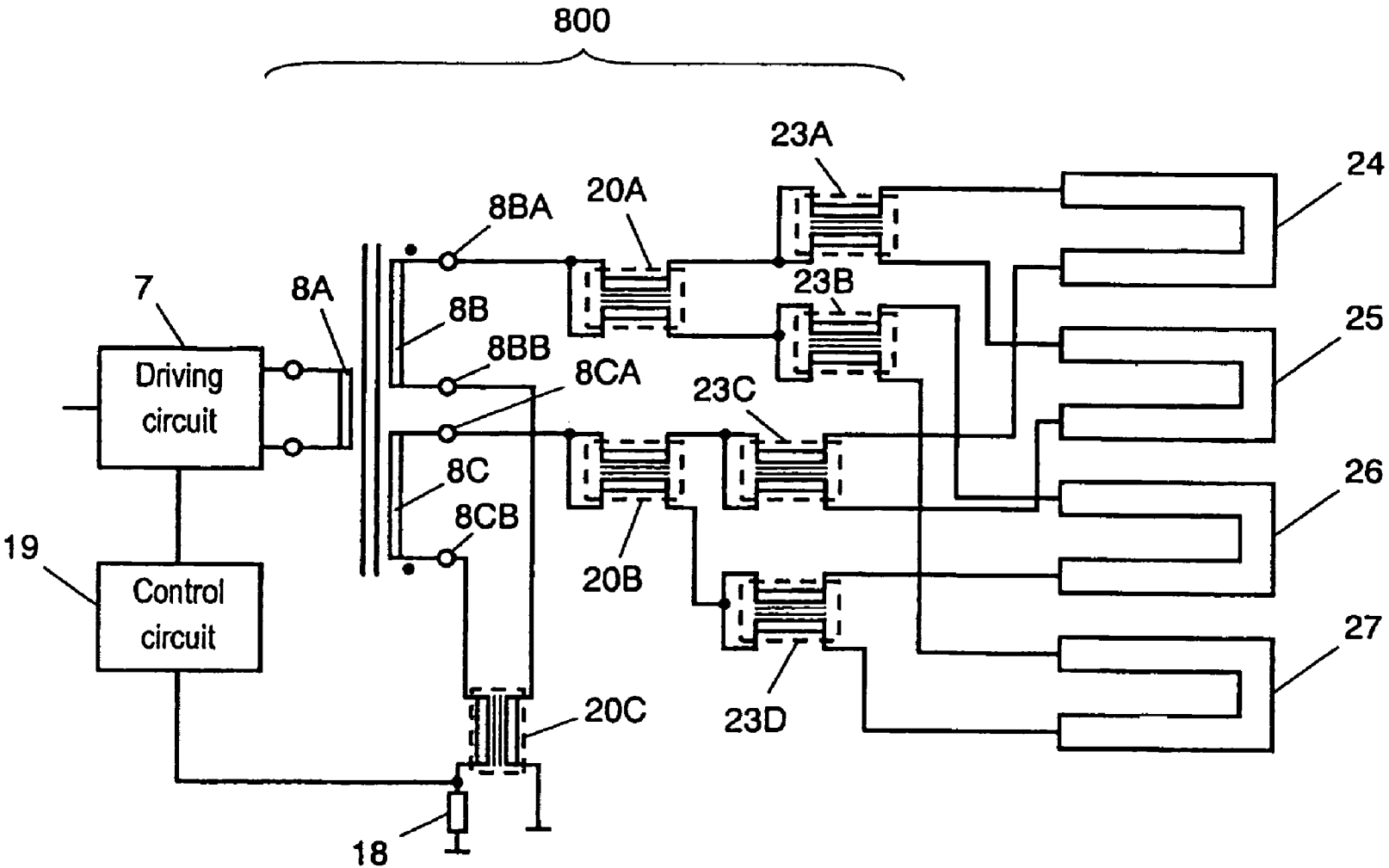
FIG. 11 is a circuit diagram of a display device using the coil component in the preferred embodiment 3 of the present invention.

FIG. 11 is a circuit diagram of a display device using the coil component in the preferred embodiment 3 of the present invention. In FIG. 11, one output end of balance coil 23A is connected to one end of lamp 24 (called first lamp), and the other end of lamp 24 is connected to one output end of balance coil 23C.

The other output end of balance coil 23A is connected to one end of lamp 25 (called second lamp), and the other end of lamp 25 is connected to the other output end of balance coil 23C.

One output end of balance coil 23B is connected to one end of lamp 26 (called third lamp), and the other end of lamp 26 is connected to one output end of balance coil 23D.

The other output end of balance coil 23B is connected to one end of lamp 27 (called fourth lamp), and the other end of lamp 27 is connected to the other output end of balance coil 23D.

In this configuration, the output current of first secondary coil 8B is uniformly distributed to balance coils 23A, 23B via balance coil 20A. The distributed output current is uniformly distributed to lamps 24, 25 via balance coil 23A, and is also uniformly distributed to lamps 26, 27 via balance coil 23B.

Also, the output current of second secondary coil 8C being reverse in polarity to the output of first secondary coil 8B is uniformly distributed to balance coils 23C, 23D via balance coil 20B. The distributed output current is uniformly distributed to lamps 24, 25 via balance coil 23C, and is also uniformly distributed to lamps 26, 27 via balance coil 23D.

Accordingly, in the configuration of the display device in the preferred embodiment 3 of the present invention, one-sided application of current to any one of lamps 24, 25, 26, 27 can be prevented. Also, it is possible to prevent the occurrence of such problem that a lamp is not supplied with the energy and unable to light up or the current is not uniformly applied to the lamps, causing the display to become uneven in brightness as a whole display.

The other ends of first and second secondary coils 8B, 8C are respectively connected to one and the other input ends of balance coil 20C, and one output end of balance coil 20C is connected to ground via resistor 18, and the other end is directly connected to ground.

Balance coil 20C serves to maintain the balance between the current flowing from first secondary coil 8B to balance coil 20A and the current flowing from second secondary coil 8C to balance coil 20B, thereby preventing the voltages applied to one and the other ends of lamp 24, 25, 26, 27 from becoming unbalanced.

And, control circuit 19 detects the current flowing in resistor 18 and directs driving circuit 7 to keep the amount of current at a certain level. In this way, the current flowing in lamps 24, 25, 26, 27 become constant.

In this configuration, when a current flows into primary coil 8A with driving circuit 7 operated, the magnetic flux generated by the current runs through outer magnetic leg 13B shown in FIG. 3, and due to the magnetic flux, currents being even in phase are generated in first and second secondary coils 8B, 8C. Since the even phase currents flow into one end and the other end of lamps 24, 25, 26, 27 respectively, the light emitting status becomes, as shown in FIG. 17, such that flicker is reduced on the display screen of the display device.

Further, four lamps 24, 25, 26, 27 can be lighted by one coil component 800, and it is possible to reduce the size of the whole display.

Also, since the amount of current is directly controlled by control circuit 19, the currents flowing in lamps 24, 25, 26, 27 are controlled with great accuracy.

Further, there are provided balance coils 20A, 20B, 23A, 23B, 23C, 23D and it is possible to prevent the one-sided application of current to any one of lamps 24, 25, 26, 27. Also, lighting failure of other lamps with any one of the lamps lighted can be prevented, and it is possible to prevent the display from becoming uneven in brightness as a whole display.

Figure 12:
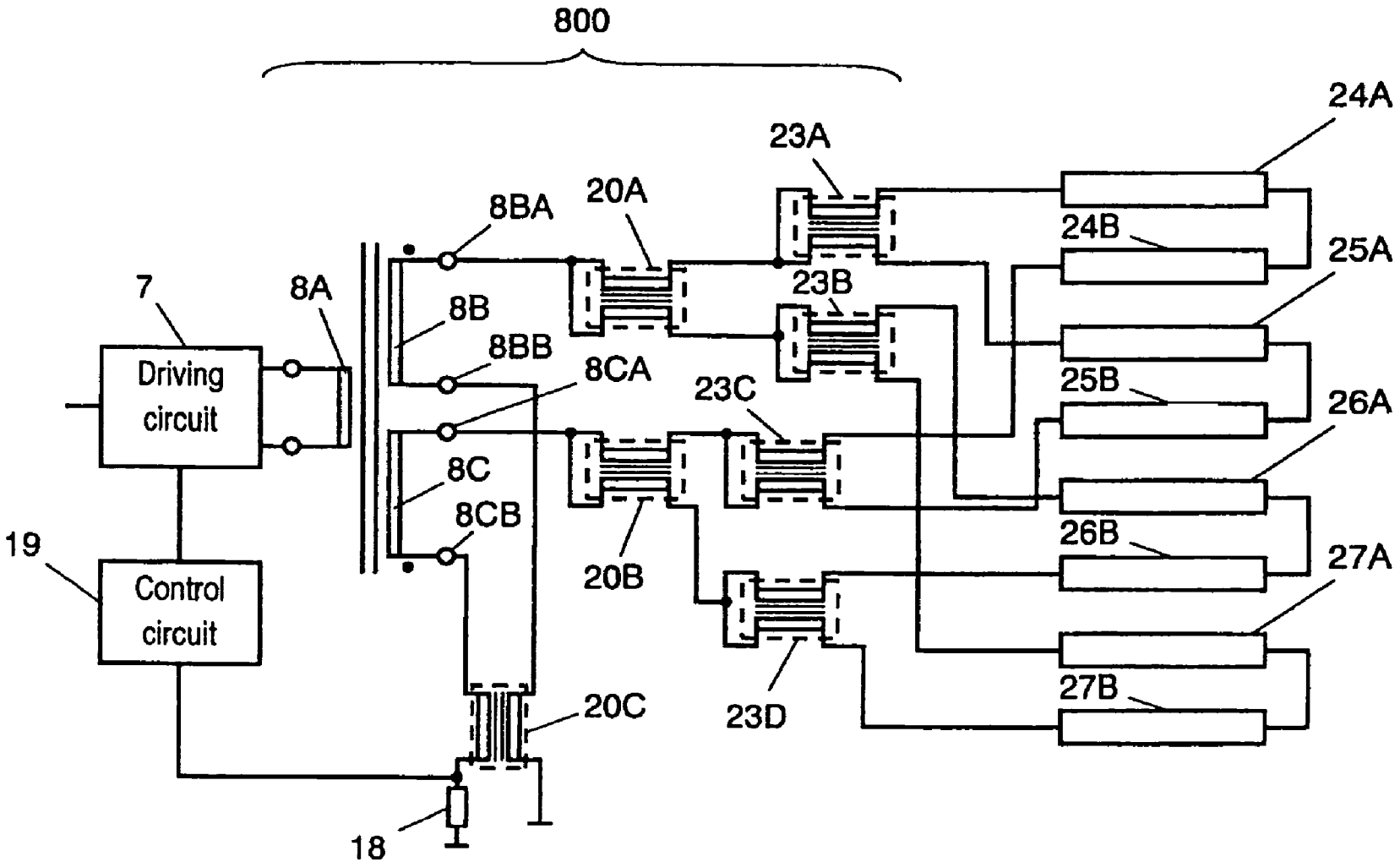
FIG. 12 PRIOR ART
FIG. 12 is a circuit diagram of another display device using the coil component in the preferred embodiment 3 of the present invention.
Figure 13:
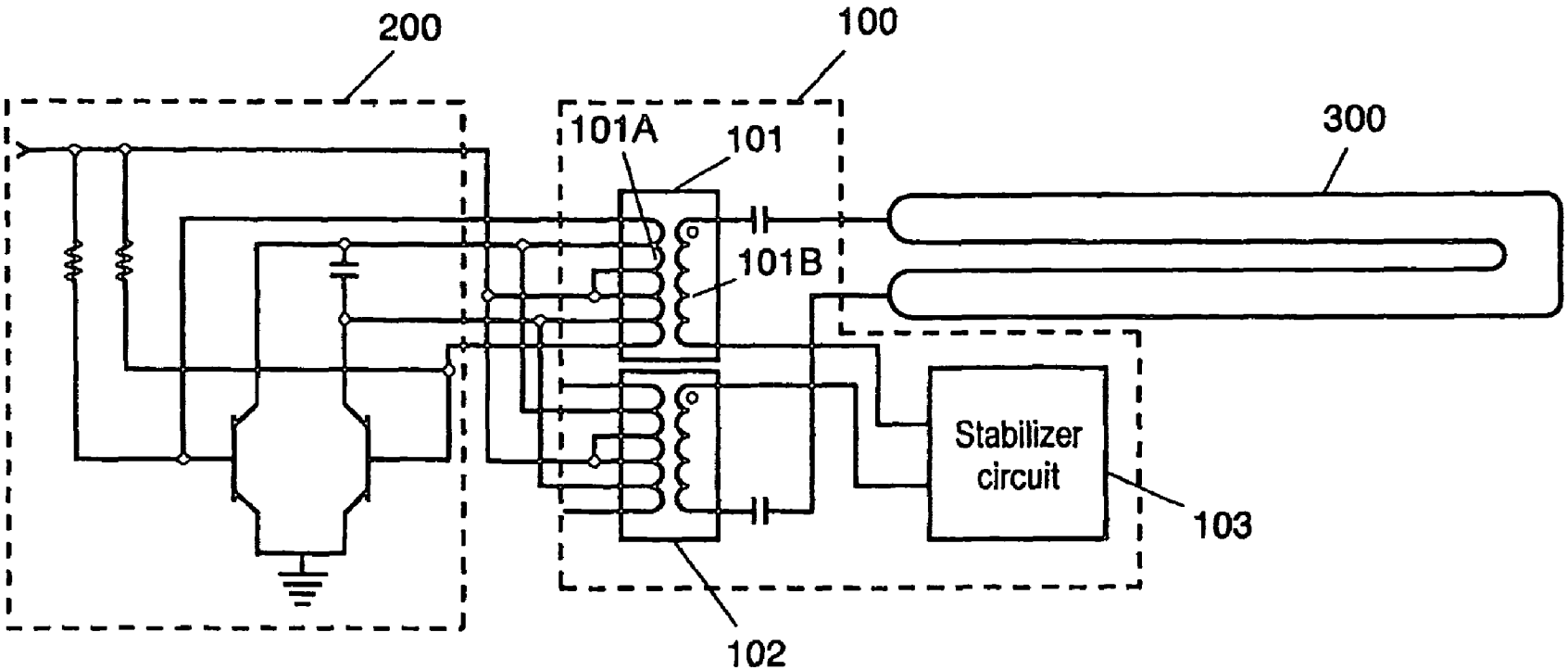
FIG. 13 PRIOR ART
FIG. 13 is a circuit diagram of a display device using a conventional coil component.
Figure 14:
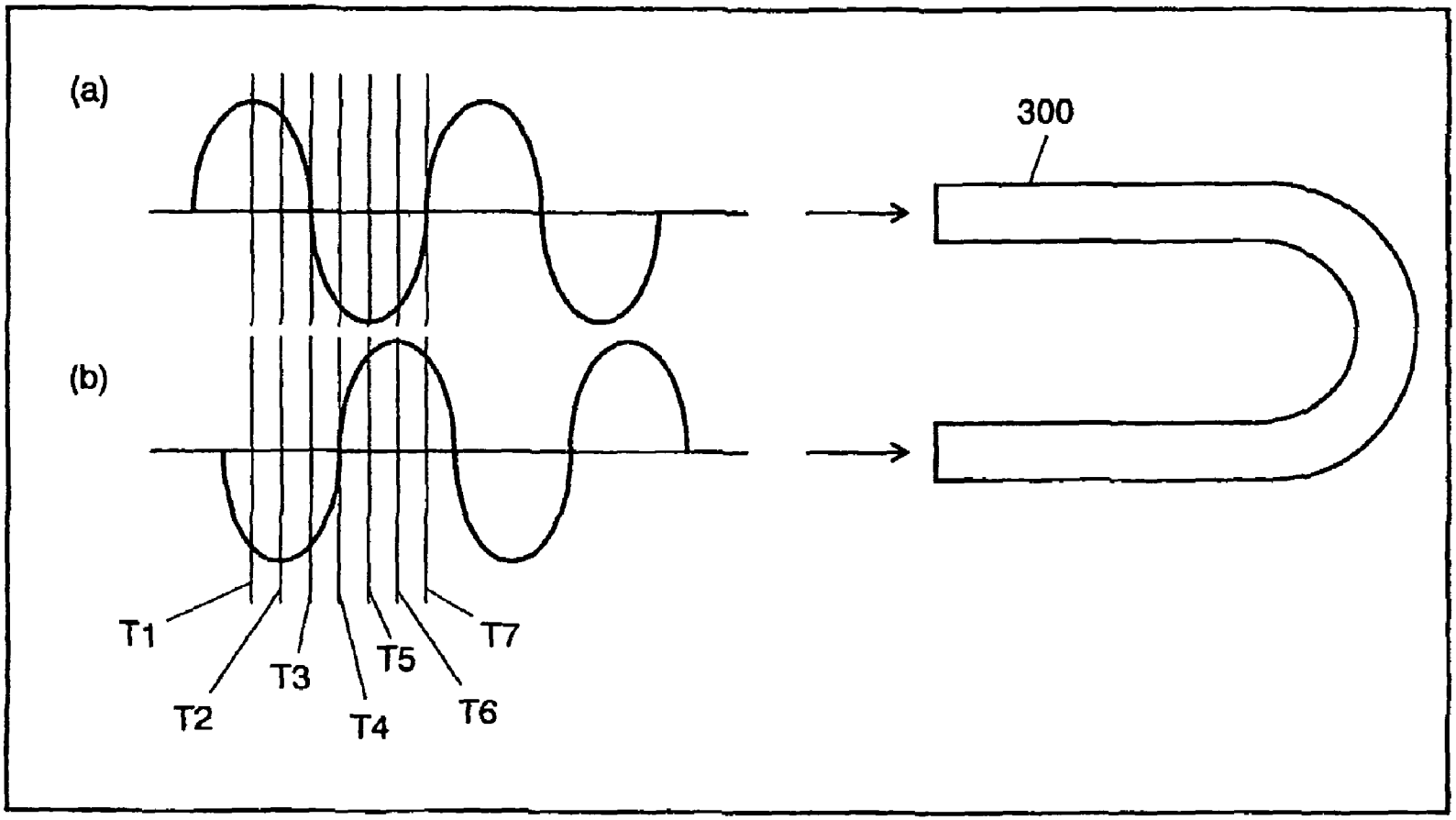
FIG. 14 PRIOR ART
FIG. 14 shows a state of phase-shifted current flowing into a conventional lamp.
Figure 15A:
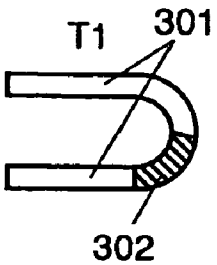
PRIOR ART FIG. 15A
FIG. 15A shows a light emitting status of a conventional lamp in a state of phase shift.
Figure 15B:
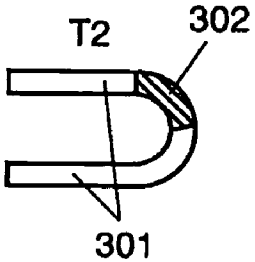
FIG. 15B shows a light emitting status of a conventional lamp in a state of phase shift.
Figure 15C:
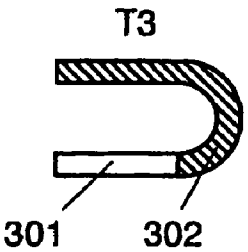
FIG. 15C shows a light emitting status of a conventional lamp in a state of phase shift.
Figure 15D:
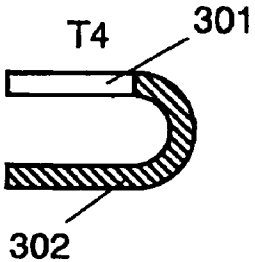
FIG. 15D shows a light emitting status of a conventional lamp in a state of phase shift.
Figure 15E:
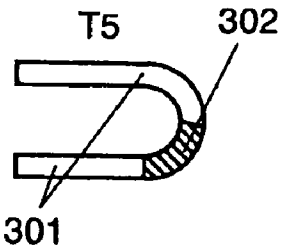
FIG. 15E shows a light emitting status of a conventional lamp in a state of phase shift.
Figure 15F:
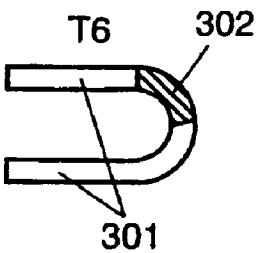
FIG. 15F shows a light emitting status of a conventional lamp in a state of phase shift.
Figure 15G:
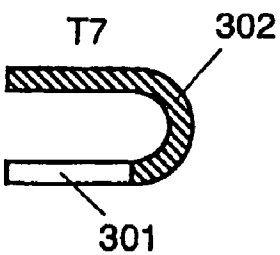
FIG. 15G shows a light emitting status of a conventional lamp in a state of phase shift.
Figure 16:
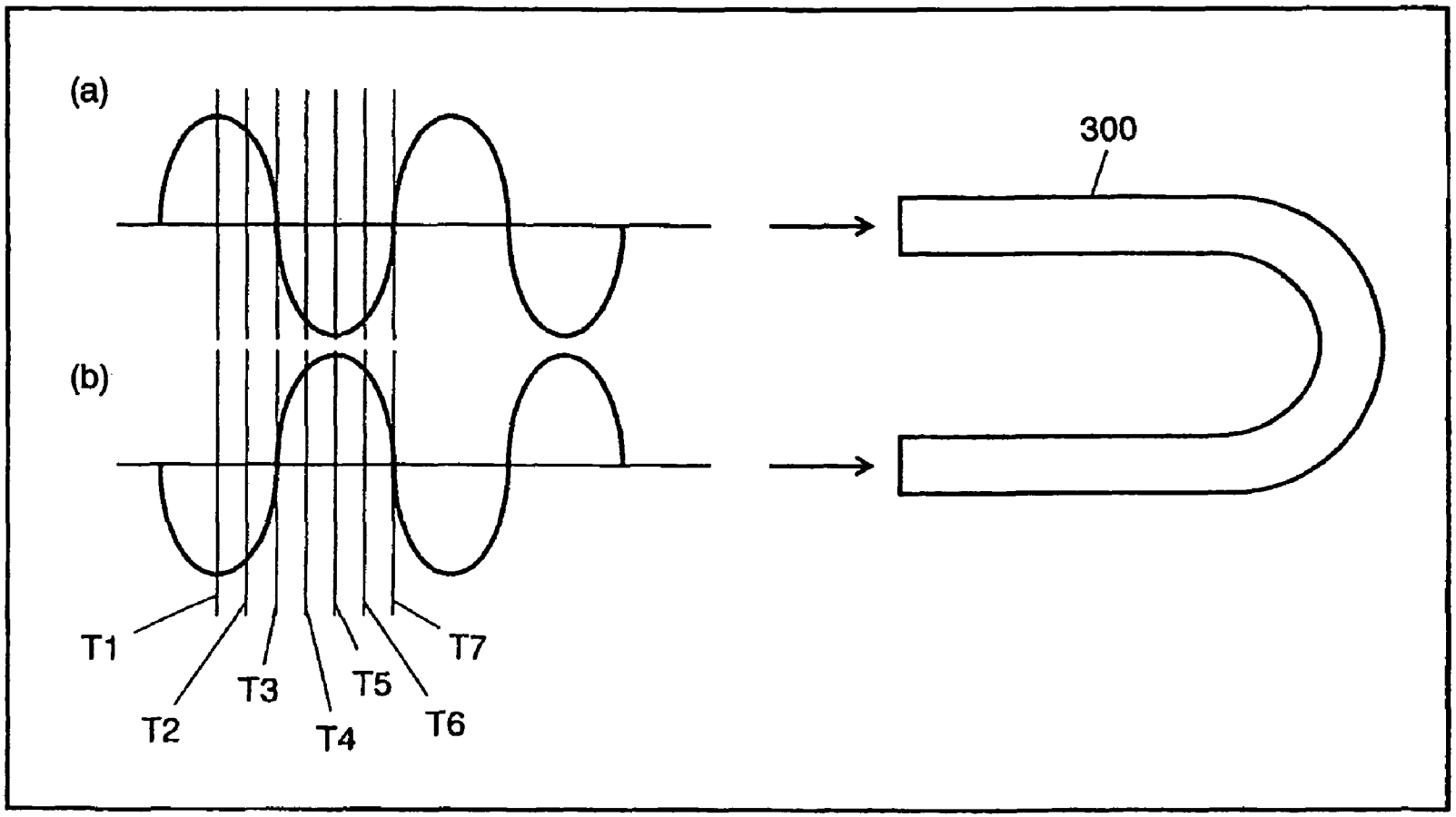
FIG. 16 PRIOR ART
FIG. 16 shows a state of even phase current flowing into a lamp.
Figure 17A:
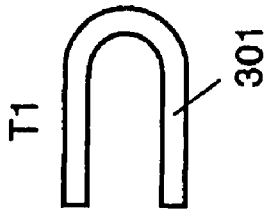
PRIOR ART FIG. 17A
FIG. 17A shows a light emitting status of a lamp in a state of even phase.
Figure 17B:
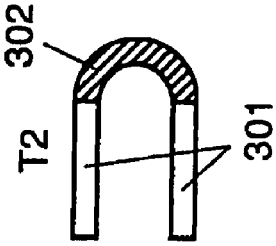
FIG. 17B shows a light emitting status of a lamp in a state of even phase.
Figure 17C:
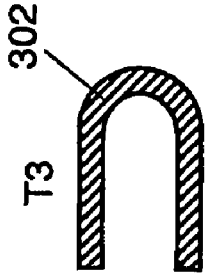
FIG. 17C shows a light emitting status of a lamp in a state of even phase.
Figure 17D:
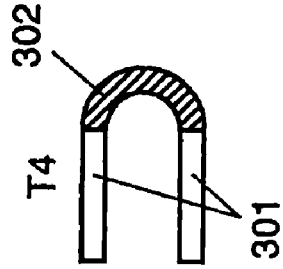
FIG. 17D shows a light emitting status of a lamp in a state of even phase.
Figure 17E:
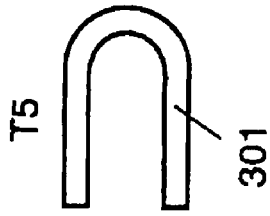
FIG. 17E shows a light emitting status of a lamp in a state of even phase.
Figure 17F:
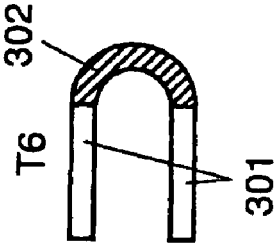
FIG. 17F shows a light emitting status of a lamp in a state of even phase.
Figure 17G:
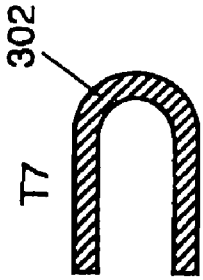
FIG. 17G shows a light emitting status of a lamp in a state of even phase.
Figure 18:
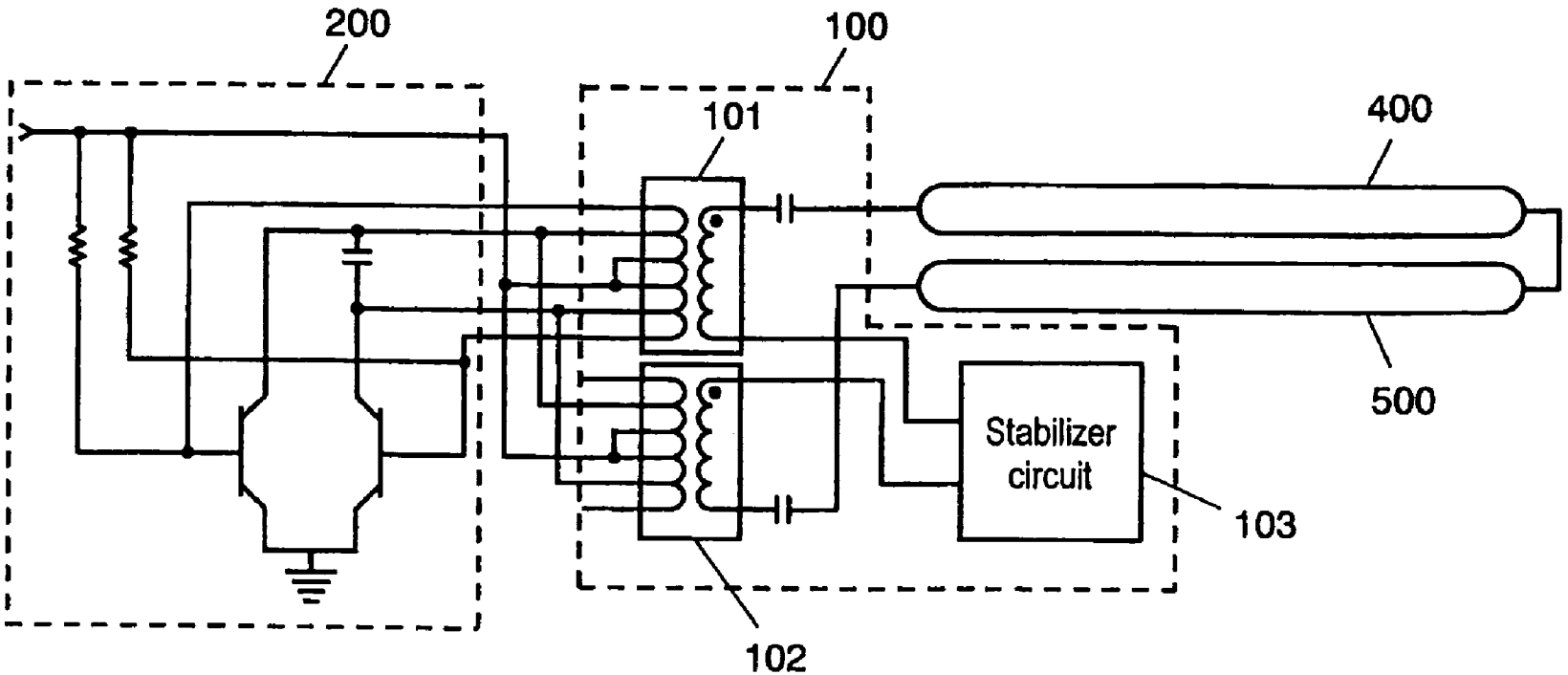
FIG. 18 PRIOR ART
FIG. 18 is a circuit diagram of another display device using a conventional coil component.

In place of lamps 24, 25, 26, 27 as shown in FIG. 12, it is also preferable to have a configuration such that lamp 24 is connected lamp 24B, lamp 25A is connected to lamp 25B, lamp 26A is connected to lamp 26B, and lamp 27A is connected to lamp 27B.

INDUSTRIAL APPLICABILITY

The coil component and the display device using the same of the present invention brings about such advantage that flicker on the display screen of the display device can be reduced, which is therefore useful for various electric apparatuses.

The invention claimed is:

1. A coil component comprising:

a primary coil;

a first secondary coil and a second secondary coil which are opposed to the primary coil, wherein a terminal at a high-voltage side of the first secondary coil is a first terminal, a terminal at a high-voltage side of the second secondary coil is a second terminal, the first secondary coil and the second secondary coil are each coaxially disposed along a common portion of a core to conduct an alternating current substantially even in phase induced by a magnetic flux through the common portion of the core, and the first terminal and the second terminal are reverse in polarity;

a first balance coil with an input connected to the first terminal;

a second balance coil with an input connected to the second terminal; and a third balance coil comprising one input end connected to a third terminal that is another end of the first secondary coil different from the first terminal, and a second input end connected to a fourth terminal that is a second end of the second secondary coil different from the second terminal.

2. The coil component of claim 1 further comprising:

a fourth balance coil with an input connected to one output end of the first balance coil;

a fifth balance coil with an input connected to a second output end of the first balance coil;

a sixth balance coil with an input connected to one output end of the second balance coil; and a seventh balance coil with an input connected to a second output end of the second balance coil.

3. A display device comprising the coil component of claim 2, a driving circuit, first, second, third and fourth lamps, and a control circuit, wherein the driving circuit is connected to the primary coil side, one end of the first lamp is connected to one output end of the fourth balance coil, and a second end of the first lamp is connected to one output end of the sixth balance coil, one end of the second lamp is connected to another output end of the fourth balance coil, and a second end of the second lamp is connected to another output end of the sixth balance coil, one end of the third lamp is connected to one output end of the fifth balance coil, and a second end of the third lamp is connected to one output end of the seventh balance coil, one end of the fourth lamp is connected to another output end of the fifth balance coil, and a second end of the fourth lamp is connected to another output end of the seventh balance coil, and the control circuit is connected to the driving circuit, and also, to the output side of the third balance coil.

4. A display device comprising the coil component of claim 1, a driving circuit, a first lamp, and a control circuit, wherein the driving circuit is connected to the primary coil side, one end of the first lamp is connected to the first terminal, and a second end of the first lamp is connected to the second terminal, and the control circuit is connected to the driving circuit, and also, to a third terminal forming the second end of the first secondary coil different from the first terminal, and to a fourth terminal, the second end of the second secondary coil different from the second terminal; the display device further comprising:

a second lamp, wherein one end of the second lamp is connected to the first terminal, and another end of the second lamp is connected to the second terminal;

a first balance coil with an input connected to the first terminal, one output end connected to one end of the first lamp, and another output end connected to one end of the second lamp;

a second balance coil with an input connected to the second terminal, one output end connected to another end of the first lamp, and a second output end connected to the another end of the second lamp; and a third balance coil with one end input end connected to the third terminal, another input end connected to the fourth terminal, and an output side grounded.

5. A coil component comprising:

a primary coil;

a first secondary coil and a second secondary coil which are opposed to the primary coil, wherein a terminal at a high-voltage side of the first secondary coil is a first terminal, a terminal at a high-voltage side of the second secondary coil is a second terminal, the first secondary coil and the second secondary coil are coaxially disposed, and the first terminal and the second terminal are reverse in polarity;

a first balance coil with an input connected to the first terminal;

a second balance coil with an input connected to the second terminal; and a third balance coil comprising a first input end connected to a third terminal that is another end of the first secondary coil different from the first terminal, and a second input end connected to a fourth terminal that is another end of the second secondary coil different from the second terminal.

6. A display device comprising:

a primary coil;

a first secondary coil and a second secondary coil which are opposed to the primary coil, wherein a terminal at the high-voltage side of the first secondary coil is a first terminal, a terminal at the high-voltage side of the second secondary coil is a second terminal, the first secondary coil and the second secondary coil are coaxially disposed, and the first terminal and the second terminal are reverse in polarity;

a driving circuit;

a first lamp;

a second lamp comprising a first end connected to the first terminal and a second end connected to the second terminal;

a control circuit, wherein the driving circuit is connected to the primary coil side, one end of the first lamp is connected to the first terminal, and the other end of the first lamp is connected to the second terminal, and the control circuit is connected to the driving circuit, and also, to a third terminal, the other end of the first secondary coil different from the first terminal, and to a fourth terminal, the other end of the second secondary coil different from the second terminal;

a first balance coil with an input connected to the first terminal, one output end connected to one end of the first lamp, and the other output end connected to one end of the second lamp;

a second balance coil with an input connected to the second terminal, one output end connected to the other end of the first lamp, and the other output end connected to the other end of the second lamp; and a third balance coil with one end input end connected to the third terminal, the other input end connected to the fourth terminal, and the output side is grounded.

* * * * *